US007370815B2

(12) United States Patent
Fecht et al.

(10) Patent No.: US 7,370,815 B2
(45) Date of Patent: May 13, 2008

(54) CONE NOZZLE

(75) Inventors: Albert Fecht, Riederich (DE); Lars Vater, Pliezhausen (DE); Juergen Frick, Weinstadt (DE)

(73) Assignee: Lechler GmbH, Metzingen (DE)

( * ) Notice: Subject to any disclaimer, the term of this patent is extended or adjusted under 35 U.S.C. 154(b) by 213 days.

(21) Appl. No.: 11/014,577

(22) Filed: Dec. 16, 2004

(65) Prior Publication Data

US 2005/0133628 A1 Jun. 23, 2005

(30) Foreign Application Priority Data

Dec. 17, 2003 (DE) ..... 103 61 349

(51) Int. Cl.
*B05B 1/34* (2006.01)
*A62C 31/02* (2006.01)
*B05B 1/26* (2006.01)

(52) U.S. Cl. ..... 239/492; 239/490; 239/552; 239/590.3; 239/601

(58) Field of Classification Search ..... 239/132, 239/139, 463, 490–497, 391, 396, 436, 443, 239/444, 465, 476, 477, 569, 601, 468–472, 239/475, 598, 599, 489
See application file for complete search history.

(56) References Cited

U.S. PATENT DOCUMENTS

| | | | | | |
|---|---|---|---|---|---|
| 2,341,859 | A | * | 2/1944 | Edwards | 239/543 |
| 3,326,473 | A | | 6/1967 | Wahlin | |
| 3,510,065 | A | * | 5/1970 | Gigantino et al. | 239/590 |
| 3,968,931 | A | * | 7/1976 | Smith | 239/125 |
| 4,014,470 | A | | 3/1977 | Burnham | |
| 4,154,399 | A | * | 5/1979 | Riano | 239/139 |
| 4,260,110 | A | * | 4/1981 | Werding | 239/404 |
| 4,347,983 | A | | 9/1982 | Bodai | |
| 4,365,758 | A | * | 12/1982 | Schaming | 239/590 |
| 4,426,041 | A | | 1/1984 | Nieuwkamp et al. | |
| 4,848,672 | A | * | 7/1989 | Matsumoto et al. | 239/590.5 |
| 5,109,824 | A | * | 5/1992 | Okamoto et al. | 123/472 |
| 5,158,235 | A | * | 10/1992 | Johnson | 239/570 |
| 5,719,351 | A | | 2/1998 | Johnson et al. | |
| 6,322,617 | B1 | | 11/2001 | Wurz et al. | |

FOREIGN PATENT DOCUMENTS

| | | |
|---|---|---|
| DE | 301230 | 6/1919 |
| DE | 1628813 A1 | 7/1970 |
| DE | 21 23 519 B2 | 10/1975 |
| DE | 2440641 A1 | 3/1976 |
| DE | 3001774 | 7/1980 |

(Continued)

*Primary Examiner*—Kevin Shaver
*Assistant Examiner*—James S. Hogan
(74) *Attorney, Agent, or Firm*—Flynn, Thiel, Boutell & Tanis, P.C.

(57) ABSTRACT

The invention relates to a cone nozzle with a nozzle body having a swirl chamber (18), an inlet hole (22) arranged in a side wall of the swirl chamber (18) and an outlet hole (20) arranged in a first end wall of the swirl chamber (18).

Figure 1:
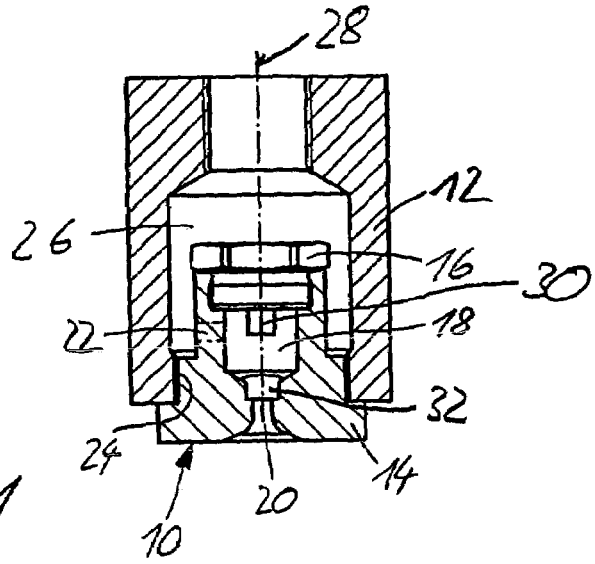

In accordance with the invention a rotation-symmetrical projection (30) or a rotation-symmetrical recess is arranged on a second end wall of the swirl chamber opposite the first end wall and at least two blind holes (32) are arranged in the first end wall adjacent to the outlet hole (20).

Use for secondary cooling of continuous billet casting plant, for example.

12 Claims, 3 Drawing Sheets

FOREIGN PATENT DOCUMENTS

| | | | |
|---|---|---|---|
| DE | 41 18 538 | C2 | 4/1994 |
| DE | 197 53 498 | C1 | 7/1999 |
| DE | 19753498 | C1 * | 7/1999 |
| DE | 199 18 120 | A1 | 10/2000 |
| DE | 199 48 939 | C1 | 10/2001 |
| EP | 0 350 250 | A1 | 1/1990 |
| EP | 0 561 697 | A1 | 9/1993 |
| GB | 1 362 317 | | 8/1974 |
| GB | 2 128 107 | A | 4/1984 |
| GB | 2 135 907 | A | 9/1984 |

* cited by examiner

CONE NOZZLE

The invention relates to a cone nozzle with a nozzle body having a swirl chamber, an inlet hole arranged in a side wall of the swirl chamber and an outlet hole arranged in a first end wall of the swirl chamber.

A full cone nozzle with axial connection is known from German patent specification DE 199 48 939 C1. This full cone nozzle has a nozzle body with a swirl chamber into which opens an inlet hole arranged tangentially to the swirl chamber wall. In a first end wall of the swirl chamber an outlet hole is arranged having a cross-section which initially tapers from the swirl chamber and then widens conically again. On an end wall of the swirl chamber opposite to the outlet hole a funnel-like bottom with several pockets is provided. The pockets form a profile arrangement that influences the circulation flow. The pockets are preferably in a five-pointed star arrangement. The medium to be sprayed is supplied to the inlet hole via a feed channel that initially extends from the inlet hole parallel to the circumference of the swirl chamber and further on turns at a right angle and continues in an axial direction.

A full cone nozzle with axial connection is known from German patent specification DE 27 00 028 C2, where a nozzle body with several vanes or guide elements is arranged inside a swirl chamber.

A further full cone nozzle with axial connection is known from the European laid-open application EP 0 350 250. Here two propeller-like nozzle bodies are arranged inside a swirl chamber.

A full cone nozzle with lateral connection is known from German patent specification DE 21 23 519. An inlet line opens there directly into an inlet hole arranged tangentially to a swirl chamber. Only a slight change of direction takes place between the feed line and the inlet hole. A plate with several openings to influence the spray pattern is arranged on the bottom of the swirl chamber.

A further full cone nozzle with lateral connection is known from German laid-open application DE 30 24 472 A1. A feed line is aligned with an inlet hole that opens tangentially into a circular-cylindrical swirl chamber. A cover of the swirl chamber has several projections in order to influence a circulation speed of the flow inside the nozzle.

A spray-drying nozzle which has a circular-cylindrical swirl chamber is known from German patent specification DE 197 53 498 C1, where an inlet hole opens into the circumference wall of the swirl chamber. An outlet hole is arranged in a first end wall of the swirl chamber. The swirl chamber is enclosed by an annular space via which the inlet hole is supplied with the medium to be sprayed. The annular space is supplied via an axial connection.

The invention is intended to create a cone nozzle that is suitable for an axial connection and that is easy to manufacture.

To do so, a cone nozzle with a nozzle body having a swirl chamber, an inlet hole arranged in a side wall of the swirl chamber and an outlet hole arranged in a first end wall of the swirl chamber is provided in accordance with the invention, where a rotation-symmetrical projection or a rotation-symmetrical recess is arranged on a second end wall of the swirl chamber opposite the first end wall and where in the first end wall adjacent to the outlet hole at least two blind holes are arranged.

Both the rotation-symmetrical projection or rotation-symmetrical recess in the second end wall and the blind holes in the first end wall can be manufactured in relatively simple manner. The first end wall is advantageously designed conical and tapers in the direction of the outlet hole. With the invention a particularly advantageous and easy to manufacture nozzle to generate a full conical jet is provided. At least two blind holes must be provided which preferably have identical dimensions, however three or four blind holes can also be provided.

In an embodiment of the invention, an annular space connected to the inlet hole and enclosing the nozzle body in the area of the inlet hole is provided.

In this way, an axial connection of the cone nozzle in accordance with the invention is made possible. The nozzle in accordance with the invention thus has the advantages of a cone nozzle less prone to clogging with a lateral connection, since no inserts whatsoever that are conducive to clogging must be provided inside the swirl chamber. Nevertheless, the cone nozzle in accordance with the invention can be axially connected and hence requires only a relatively small installation space. The cone nozzle in accordance with the invention is hence particularly suitable for use for secondary cooling of continuous billet casting plant. In particular, the cone nozzle in accordance with the invention can be replaced by conventional axial full cone nozzles by means of a simple adapter.

The projection is designed circular-cylindrical in an embodiment of the invention.

A design of the projection of this type is easy to manufacture, for example as a lathe-turned part.

A ratio of the size of the inlet hole to the size of the outlet hole can be between about 1:1 to a maximum of 1:1.5 for the cone nozzle in accordance with the invention. The ratio of the size of the inlet hole to the swirl chamber diameter can exceed 1:1.5 and a ratio of the inlet hole to the annular gap of the inlet can be 1:x, x>1.

In an embodiment of the invention, the blind holes, at least two in number, are designed circular-cylindrical.

In this way, an easy-to-manufacture design of the cone nozzle in accordance with the invention can be achieved.

In an embodiment of the invention, the blind holes, at least two in number, merge in the area of the outlet hole.

As a result, an outflow area is created by simple means in the transitional area of the blind holes and opens into the outlet hole. A design of this type is particularly advantageous in conjunction with a conical end wall tapering in the direction of the open end of the outlet hole.

In an embodiment of the invention, the central axes of the blind holes and the outlet hole are in the same plane.

Figure 8:
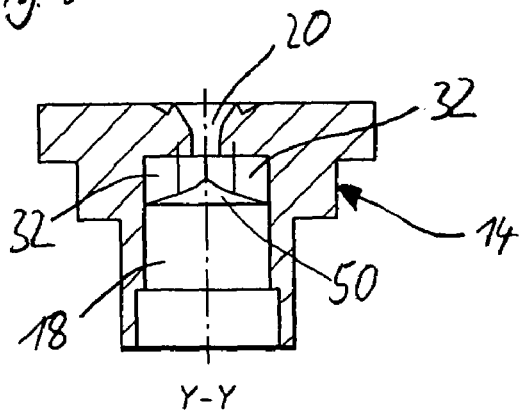

In this way, a figure-8-shaped recess is formed in the end wall, at the centre of which is arranged the outlet hole. This creates an outflow area that assures the creation of an even spray pattern.

In an embodiment of the invention, a respective circumference wall of the at least two blind holes is aligned in the area of an intersection line with the circumference wall of the swirl chamber, the intersection line being defined by the intersection of a plane running through the central axes of the respective blind hole and the swirl chamber with the circumference wall of the swirl chamber and the circumference wall of the respective blind hole.

In this way, it is possible to achieve a flow-favourable transition between the wall of the swirl chamber and the wall of the blind holes.

The problem underlying the present invention is solved by a cone nozzle with a nozzel body having a swirl chamber, an inlet hole arranged in a side wall of the swirl chamber and an outlet hole arranged in a first end wall of the swirl chamber, in which a conical projection tapering in the direction of the outlet hole is arranged on a second end wall opposite the first end wall of the swirl chamber and has on at least part of its surface at least one flow guide surface enclosing the conical projection and leading to its tapered end.

A groove or a projection can be provided as the flow guide surface at the tapering projection. The cone nozzle in accordance with the invention can have a circular-cylindrical swirl chamber with rotation-symmetrical and in particular plane end walls and is hence, at least in the area of the swirl chamber, easy to manufacture. A required circulation speed for the flow in the swirl chamber is set using the tapering projection on the second end wall.

In an embodiment of the invention, an annular space connected to the inlet hole and enclosing the nozzle body in the area of the inlet hole is provided.

In this way, the cone nozzle in accordance with the invention can be used for an axial connection.

In an embodiment of the invention, the flow guide surface is designed as a groove passing several times around the conical projection and angled relative to a central longitudinal axis of the conical projection.

By means of an all-round groove of this type, a circulation speed can be set in the swirl chamber, as a result of which the spray pattern of the cone nozzle in accordance with the invention can be influenced.

The problem underlying the invention is also solved by a cone nozzle with a nozzle body having a swirl chamber, an inlet hole arranged in a side wall of the swirl chamber and an outlet hole arranged in a first end wall of the swirl chamber, in which the outlet hole widens out from the swirl chamber.

A cone nozzle of this type is particularly impervious to clogging, since the outlet hole widens starting from the swirl chamber and hence the swirl chamber itself cannot become clogged. The swirl chamber can be of circular-cylindrical design, for example.

In an embodiment of the invention, an annular space connected to the inlet hole and enclosing the nozzle body in the area of the inlet hole is provided.

In this way, the cone nozzle in accordance with the invention can be used for an axial connection.

In an embodiment of the invention, the nozzle body is designed in one piece.

Since the outlet hole widens conically starting from the swirl chamber, the cone nozzel in accordance with the invention has no undercut between the outlet hole and the swirl chamber, and hence can be manufactured inexpensively in one piece.

Further details and advantages of the invention are shown in the claims and in the following description of preferred embodiments of the invention in conjunction with the drawings. The drawings show in FIG. 1 a partial sectional view of a cone nozzle in accordance with the invention in a first embodiment, FIG. 2 a perspective view of a swirl chamber cover for the cone nozzle of FIG. 1, FIG. 3 a side view of an alternative swirl chamber cover for the cone nozzle of FIG. 1, FIG. 4 a sectional view of a further alternative swirl chamber cover for the cone nozzle of FIG. 1, FIG. 5 a perspective view of a nozzle mouthpiece of the cone nozzle of FIG. 1, FIG. 6 a plan view of the nozzle mouthpiece of FIG. 5, FIG. 7 a sectional view along the line X-X of FIG. 6, FIG. 8 a sectional view along the line Y-Y of FIG. 6, FIG. 9 a sectional view of a further embodiment of the cone nozzle in accordance with the invention, FIG. 10 a swirl chamber cover for a further embodiment of a cone nozzle in accordance with the invention, and FIG. 11 a sectional view of a nozzle mouthpiece for use with the swirl chamber cover of FIG. 10.

The sectional view of FIG. 1 shows a full cone nozzle with axial connection having a nozzle body 10 and a connector 12 surrounding some sections of the nozzle body 10. The nozzle body 10 is designed in two parts and has a nozzle mouthpiece 14 and a swirl chamber cover 16. A swirl chamber 18 is provided inside the nozzle mouthpiece 14, and an outlet hole 20 is arranged in a first end wall of the swirl chamber 18. A second end wall of the swirl chamber 18 opposite the first end wall is formed by the swirl chamber cover 16. The swirl chamber 18 is of circular-cylindrical design, and an inlet hole 22 opens in the area of the side wall of the swirl chamber 18 into the swirl chamber 18. The inlet hole 22 is not discernible as such in the view in FIG. 1 and is therefore only shown as a dashed line.

The nozzle mouthpiece 14 has at its front end, in the area of the outlet hole 20, an all-round annular flange adjoining an area with reduced external diameter and with a male thread 24. The area with the male thread 24 adjoins an area with an even further reduced diameter in which the inlet hole 22 is arranged. Overall, therefore, the nozzle mouthpiece 14 is of stepped design. The nozzle mouthpiece 14 is screwed with the male thread 24 into a front end of the connector 12, and the annular flange of the nozzle mouthpiece 14 contacts an end face of the connector 12 and thereby defines an installation position of the nozzle mouthpiece 14. The connector 12 has an axial hole 26 starting from its front end and having in its front part a female thread that meshes with the male thread 24 of the nozzle mouthpiece 14. An internal diameter of the axial hole 26 is greater than an external diameter of the area of the nozzle mouthpiece 14 in which the inlet hole 22 is arranged. The internal diameter of the axial hole 26 is also larger than an external diameter of the swirl chamber cover 16. The result is an annular space in the area of the inlet hole 22 between the nozzle mouthpiece 14 and the connector 12. This annular space continues from the inlet hole 22 as far as the rear end of the swirl chamber cover 16. In its further course as far as the rear end of the axial hole 26 facing away from the outlet hole 20, the axial hole 26 tapers firstly conically and then merges into a connecting section with female thread. The connector 12 can thus be screwed axially onto a pipe and only requires a small installation space in the radial direction. As can be seen from FIG. 1, the cone nozzle in accordance with the invention nevertheless does not require clogging-prone swirl inserts, as provided for in conventional axial full cone nozzles. The free cross-sections of the cone nozzle in accordance with the invention are as a result about 50% to 60% greater than the free cross-sections of conventional axial full cone nozzels. The cone nozzles in accordance with the invention are hence considerably less prone to clogging than conventional axial full cone nozzles. Compared to conventional full cone nozzles with tangential connection, the cone nozzles in accordance with the invention require considerably less installation space.

A satisfactory spray pattern including the required speed distribution in a full cone generated by the nozzle in accordance with the invention is set firstly by a ratio of the size of the inlet hole 22 to the size of the outlet hole 20, which can be in a range from 1:1 to a maximum of 1:1.5. In addition, a ratio of the inlet hole to the swirl chamber diameter must be maintained that may be greater than about 1:1.5. A size of the inlet hole relative to the size of the annular gap between the connector 12 and the nozzle body 14 can be 1:1, but the gap can also be designed larger than the inlet hole. Furthermore, the arrangement of the inlet hole 22 relative to a central axis 28 of the swirl chamber 18 is important, as is set forth below. The design of the second end wall of the swirl chamber 18 formed by the swirl chamber cover 16 and also the design of the first end wall of the swirl chamber 18 adjoining the outlet hole 20 also serves to influence the circulation speed of the medium to be sprayed inside the swirl chamber 18. The swirl chamber cover 16 has on its side facing the swirl chamber 18 a circular-cylindrical projection 30 arranged concentrically to the central axis 28. The first end wall of the swirl chamber 18 merging into the outlet hole 20 is designed conical and tapering in the direction of the outlet hole 20, and furthermore two blind holes 32 are arranged in the first end wall, and are explained in greater detail in the following.

Figure 2:
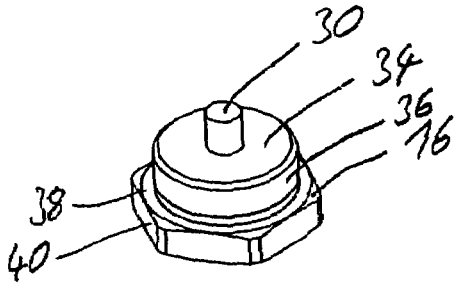

The perspective view of FIG. 2 shows the swirl chamber cover 16 in FIG. 2. The swirl chamber cover 16 is provided with a circular-cylindrical projection 30 that extends from a plane end surface 34. Starting from the projection 30, a circular-cylindrical section with an male thread 36 adjoins the end face 34. The swirl chamber cover 16 is screwed using the male thread 36 into a rear end of the nozzle mouthpiece 14 facing away from the outlet hole 20. The male thread 36 is adjoined by an annular sealing flange 38 followed by an external circumference area 40 designed as a hexagonal surface.

Figure 3:
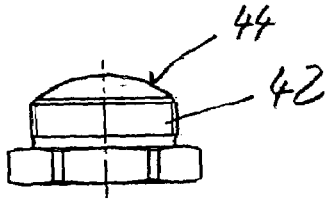

The side view in FIG. 3 shows an alternative swirl chamber cover 42. The swirl chamber cover 42 differs from the swirl chamber cover 16 in the design of an end face 44 facing the swirl chamber 18 and forming the second end wall of the swirl chamber 18 opposite the outlet hole 20. The end face 44 is designed curving outwards and hence projects into the swirl chamber 18 when assembled.

Figure 4:
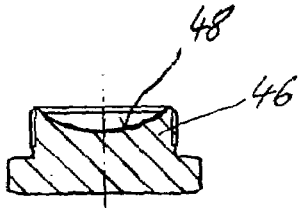

The sectional view in FIG. 4 shows a further alternative form of a swirl chamber cover 46 which also differs from the swirl chamber cover 16 only in the design of its end face 48 facing the swirl chamber 18 in its assembled state. The end face 48 is designed curving inwards so that a dished area is created in the swirl chamber cover 46 by the end face 48. In the assembled state, this dished area thus expands the swirl chamber 18 in a direction away from the outlet hole 20.

Figure 5:
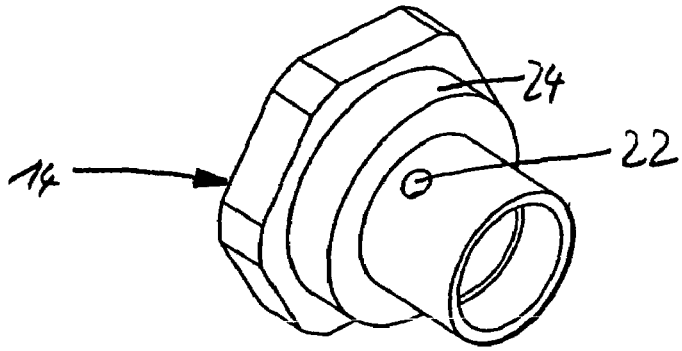

The perspective view in FIG. 5 shows the nozzle mouthpiece 14 of FIG. 1 seen from the rear at an angle. It can be discerned that the inlet hole 22 is arranged off-centre, so that the medium to be sprayed is passed through the inlet hole 22 into the swirl chamber 18 such that a circulation flow is generated in the swirl chamber 18. It can further be seen that the circumference of the first area of the nozzle mouthpiece 14, which is on the side of the outlet hole 20, has several faces and is designed like a hexagonal nut to permit screwing of the nozzle mouthpiece 14 into the connector 12 shown in FIG. 1.

Figure 6:
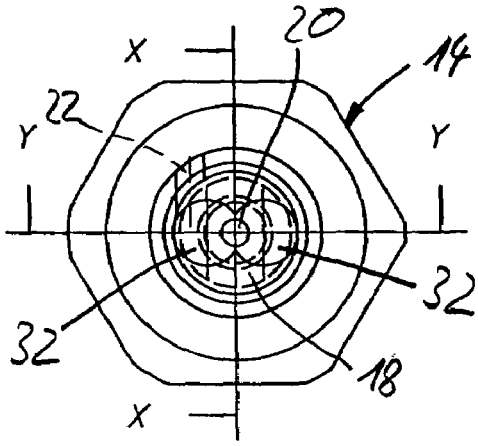

The plan view of FIG. 6 shows the nozzle mouthpiece 14 of FIG. 1, where elements not as such discernible in the view in FIG. 6 are only shown by dashed lines. This applies for example to the inlet hole 22, shown by dashed line, of which the off-centre position relative to the swirl chamber 18 is clearly discernible. The inlet hole 22 opens into the swirl chamber 18 in such a way that a flow is introduced off-centre but not yet tangentially into the swirl chamber 18. As clearly shown in FIG. 6, the two blind holes 32 in the first end wall are arranged adjacent to the outlet hole 20. The two blind holes 32 are designed circular-cylindrical and have the same dimensions, and their central axes and the central axis of the outlet hole 20 are in the same plane. The blind holes 32 each have a diameter greater than half the internal diameter of the swirl chamber 18. The blind holes 32 on the one hand continue the internal circumference wall of the swirl chamber 18 and overlap in the area of the outlet hole 20.

Overall, the two blind holes 32 result in an figure-8-shaped recess in the first end wall of the swirl chamber 18, where the outlet hole 20 is arranged at the centre of this figure-8-shaped recess made up of the two blind holes 32. The two blind holes 32 serve to influence the circulation speed of the flow in the swirl chamber 18 and to form a drain area in the vicinity of the outlet hole 20.

Figure 7:
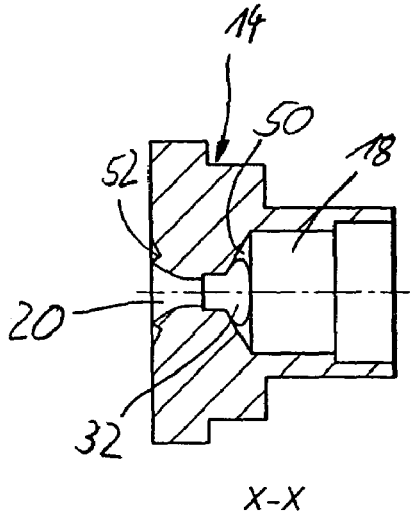

In the sectional view in FIG. 7 along the line X-X in FIG. 6, one of the blind holes 32 and its arrangement relative to the outlet hole 20 can be seen.

It can furthermore be seen that the first end wall 50 of the swirl chamber 18 is designed conical and tapers in the direction of the outlet hole 20.

An all-round and triangular-section recess 52 is provided around the outlet hole 20 in that end face of the nozzle mouthpiece 14 which is facing away from the swirl chamber 18.

In the sectional view in FIG. 8 along the line Y-Y, the conical design of the first end wall of the swirl chamber 18 can also be discerned. It can furthermore be seen that the circumference walls of the two blind holes 32 are aligned in the sectional plane y-y in FIG. 8 with the circumference wall of the swirl chamber 18. In the sectional plane in FIG. 8 defined by the intersection of the circumference wall of the swirl chamber 18 with a plane in which lie the central axes of the two blind holes 32 and of the outlet hole 20, a respective circumference wall of a blind hole 32 and the circumference wall of the swirl chamber 18 are thus aligned, so that a continuous straight line is obtained in the view in FIG. 8.

Figure 9:
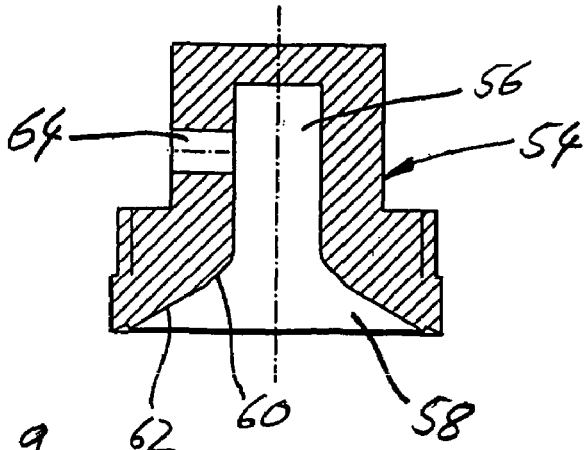

The sectional view in FIG. 9 shows a further preferred embodiment of the cone nozzle in accordance with the invention for generating a full conical spray pattern, where only a nozzle mouthpiece 54 is shown in the view in FIG. 9. The nozzle mouthpiece 54 is intended for installation in a connector corresponding to the connector 12 in FIG. 1. In the case of the nozzle mouthpiece 54, a circular-cylindrical designed swirl chamber 54 merges without constriction of the cross-section into an outlet hole 58. Starting from the swirl chamber 56, this outlet hole 58 widens conically, where a first cone area 60 with a first cone angle is provided opposite the circumference wall of the swirl chamber 56 and a second cone area 62 adjoining the first cone area 60, where the second cone area 62 opposite the circumference wall of the swirl chamber 56 has a wider angle. The outlet hole 58 accordingly widens, starting from the swirl chamber 56, in two stages by means of the cone areas 60, 62. An inlet hole 64 arranged centrally to the swirl chamber 56 opens into the circumference wall of the swirl chamber 56, so that the central axes of the inlet hole 64 and of the swirl chamber 56 intersect. A second end wall of the swirl chamber 56 opposite the outlet hole 58 is designed plane. Overall, the nozzle mouthpiece 54 thus has a particularly simple shape which is very little prone to clogging. A crucial advantage of the nozzle mouthpiece 54 is that it can be manufactured in one piece. The nozzle mouthpiece 54 can be screwed into the connector shown in FIG. 1.

Figure 10:
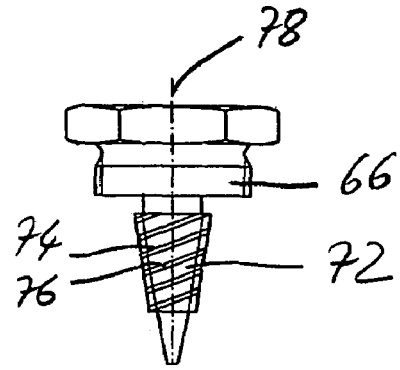
Figure 11:
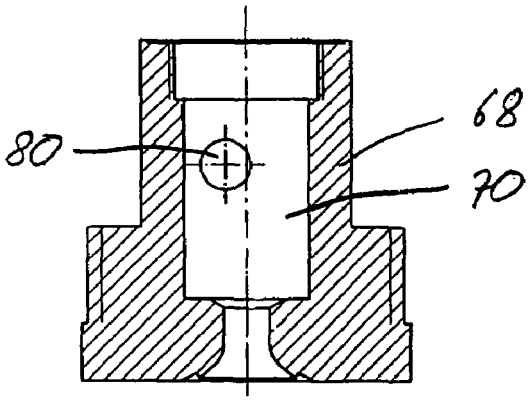

The side view of FIG. 10 shows a swirl chamber cover 66 intended for insertion into a nozzle mouthpiece 68 shown in a sectional view in FIG. 11. The swirl chamber cover 66 has on its end face facing a swirl chamber 70 of the nozzle mouthpiece 68 a conical projection 72 having two parallel and all-round grooves 74 and 76 on one section of its circumference. One direction in which the grooves 74, 76 extend is angled to a central axis 78 of the swirl chamber cover 66. The conical projection 72 with the grooves 74, 76 ensures an adjustment of the circulation speed inside the swirl chamber 70 to the extent permitting a required spray pattern.

As shown in the sectional view in FIG. 1, an inlet hole 80 opens off-centre into the swirl chamber 70 such that a circulating current is generated in the swirl chamber 70 of which the circulation speed is then controlled by the projection 72 of the swirl chamber cover 66.

The nozzle mouthpiece 68 is intended for an axial full cone nozzle and is screwed into a connector corresponding to the connector 12 shown in FIG. 1.

The invention claimed is:

1. Cone nozzle with a nozzle body having a swirl chamber, an inlet hole arranged in a sidewall of the swirl chamber and an outlet hole arranged in a first end wall of the swirl chamber, wherein a rotation-symmetrical projection or a rotation-symmetrical recess is arranged on a second end wall of the swirl chamber opposite the first end wall and in that at least two blind holes are arranged in the first end wall adjacent to the outlet hole and within the swirl chamber.

2. Cone nozzle according to claim 1, wherein an annular space connected to the inlet hole and enclosing the nozzle body in the area of the inlet hole is provided.

3. Cone nozzle according to claim 1, wherein the projection is designed circular-cylindrical.

4. Cone nozzle according to claim 1, wherein the at least two blind holes are designed circular-cylindrical.

5. Cone nozzle according to claim 1, wherein the at least two blind holes merge in the area of the outlet hole.

6. Cone nozzle according to claim 5, wherein the central axes of the blind holes and of the outlet hole are in the same plane.

7. Cone nozzle according to claim 1, wherein a respective circumference wall of the at least two blind holes is aligned in the area of an intersection line with the circumference wall of the swirl chamber, the intersection line being defined by the intersection of a plane which runs through the central axis of the respective blind hole and the central axis of the swirl chamber with the circumference wall of the swirl chamber and the circumference wall of the respective blind hole.

8. Cone nozzle with a nozzle body having a swirl chamber, an inlet hole arranged in a side wall of the swirl chamber and an outlet hole arranged in a first end wall of the swirl chamber, wherein said swirl chamber is of circular-cylindrical design and merges without constriction into said outlet hole, and wherein said outlet hole widens conically starting from the swirl chamber.

9. Cone nozzle according to claim 8, wherein an annular space connected to the inlet hole and enclosing the nozzle body in the area of the inlet hole is provided.

10. Cone nozzle according to claim 8, wherein the nozzle body is designed in one piece.

11. Cone nozzle with a nozzle body having a swirl chamber, with an inlet hole arranged in a sidewall of the swirl chamber and an outlet hole arranged in a first end wall of the swirl chamber, a rotation-symmetrical projection arranged on a second end wall of the swirl chamber opposite the first end wall, and at least two blind holes arranged in the first end wall adjacent to the outlet hole and between the inlet hole and the outlet hole.

12. Cone nozzle with a nozzle body having a swirl chamber, with an inlet hole arranged in a sidewall of the swirl chamber and an outlet hole arranged in an end wall of the swirl chamber, and at least two blind holes arranged in said end wall upstream of the outlet hole.

* * * * *